US009163534B2

(12) United States Patent
Girard et al.

(10) Patent No.: US 9,163,534 B2
(45) Date of Patent: Oct. 20, 2015

(54) VALVE ACTUATION MECHANISM AND AUTOMOTIVE VEHICLE COMPRISING SUCH A VALVE ACTUATION MECHANISM

(75) Inventors: Benjamin Girard, Saint Laurent de Mure (FR); Romain Le Forestier, Reyrieux (FR)

(73) Assignee: Volvo Trucks AB, Göteborg (SE)

( * ) Notice: Subject to any disclaimer, the term of this patent is extended or adjusted under 35 U.S.C. 154(b) by 108 days.

(21) Appl. No.: 14/127,293

(22) PCT Filed: Jul. 22, 2011

(86) PCT No.: PCT/IB2011/002439

§ 371 (c)(1),
(2), (4) Date: Dec. 18, 2013

(87) PCT Pub. No.: WO2013/014489

PCT Pub. Date: Jan. 31, 2013

(65) Prior Publication Data

US 2014/0137838 A1 May 22, 2014

(51) Int. Cl.

| | |
|---|---|
| ***F01L 1/18*** | (2006.01) |
| ***F01L 13/06*** | (2006.01) |
| ***F01L 13/00*** | (2006.01) |
| ***F01L 13/08*** | (2006.01) |
| ***F01L 1/46*** | (2006.01) |
| ***F02D 13/02*** | (2006.01) |

(52) U.S. Cl.

CPC ..... *F01L 13/06* (2013.01); *F01L 1/181* (2013.01); *F01L 1/46* (2013.01); *F01L 13/0021* (2013.01); *F01L 13/08* (2013.01); *F02D 13/0242* (2013.01)

(58) Field of Classification Search

CPC ..... F01L 1/46; F01L 1/24; F01L 1/2405; F01L 1/2411; F01L 1/2416; F01L 1/2422; F01L 1/181; F01L 13/0021

USPC ..... 123/90.39, 90.44, 90.45, 90.46

See application file for complete search history.

(56) References Cited

U.S. PATENT DOCUMENTS

| | | | |
|---|---|---|---|
| 6,253,730 | B1 | 7/2001 | Gustafson |
| 6,422,186 | B1 | 7/2002 | Vanderpoel |

(Continued)

FOREIGN PATENT DOCUMENTS

| | | | |
|---|---|---|---|
| WO | 9009514 | A1 | 2/1990 |
| WO | 9108381 | A1 | 6/1991 |

(Continued)

OTHER PUBLICATIONS

International Search Report (Apr. 3, 2012) for corresponding International application No. PCT/IB2011/002439.

*Primary Examiner* — Hung Q Nguyen
(74) *Attorney, Agent, or Firm* — WRB-IP LLP

(57) ABSTRACT

A valve actuation mechanism for an internal combustion engine includes rockers moved by a camshaft, each rocker being adapted to exert a valve opening force on at least a portion of a valve opening actuator of each cylinder, via an activation piston, housed in a bore of the rocker and movable with respect to the rocker under action of a fluid pressure raise in a chamber fluidly connected to the bore, from a first position to a second position with respect to the rocker, in which a cam follower of the rocker is adapted to read at least one auxiliary valve lift sector of a cam of the camshaft so as to perform an engine operating function. Each rocker includes a check valve adapted to control the fluid pressure raise in the chamber. The valve actuation mechanism includes, for each rocker, a stopper fast with a housing of the engine and adapted to exert, on a member of the rocker, a force for opening a valve independent from the check valve, adapted to release fluid from the chamber when the piston has to be moved from its second position to its first position.

18 Claims, 6 Drawing Sheets

(56) References Cited

U.S. PATENT DOCUMENTS

| | | | | |
|---|---|---|---|---|
| 7,392,777 | B2 * | 7/2008 | Faria et al. | 123/90.39 |
| 2003/0024501 | A1 | 2/2003 | McCarthy et al. | |
| 2010/0307451 | A1 | 12/2010 | Lee et al. | |

FOREIGN PATENT DOCUMENTS

| | | | |
|---|---|---|---|
| WO | 02101212 | A1 | 12/2002 |
| WO | 2005089274 | A2 | 9/2005 |

* cited by examiner

VALVE ACTUATION MECHANISM AND AUTOMOTIVE VEHICLE COMPRISING SUCH A VALVE ACTUATION MECHANISM

BACKGROUND AND SUMMARY

The invention concerns a valve actuation mechanism for an internal combustion engine on an automotive vehicle. The invention also concerns an automotive vehicle, such as a truck, equipped with such a valve actuation mechanism.

Automotive vehicles, such as trucks, often rely on an engine brake function to slow down in order, for example, to reduce wear of the friction brake pads and to prevent overheating of the friction brakes, particularly on downward slopes. It is known to perform engine brake by acting on the amount of gas present in the cylinders of the engine in two distinct phases. In a first phase, when the pistons are near a bottom dead center, one injects exhaust gases into the chambers of the cylinders so as to slow down the pistons when they move towards their high level. This is done by slightly opening at least a valve connected to an exhaust manifold, while exhaust gases are prevented to be expelled from the exhaust pipe and thereby at a certain pressure above atmospheric pressure. In the second phase, the gases which are compressed by the piston are expelled from the chamber of the cylinder when the piston is at or near its top dead center position in order to prevent an acceleration of the piston under effect of volumic expansion of compressed gas. This is done by slightly opening a valve so as to expel gases from the cylinder. In most cases, the valve (or valves) which is (are) opened for the engine brake function is (are) a main exhaust valve. An engine brake system is described in document WO 9009514.

To perform these engine brake valves movements, also called engine brake valves lifts, the engine comprises, for each cylinder, a rocker acting, on the valves to open and close them. The rocker is acted upon by a rotating cam which has at least one lift sector to cause the lifting (opening) of the valve. If the valve is also an exhaust or an intake valve, the corresponding cam will comprise a main valve lift sector and one or several auxiliary valve lift sectors (also called main valve lift bump and auxiliary valve lift bump) When engine brake is needed, a cam follower surface of the rocker is moved in close contact with a cam of a camshaft moving the rocker so that the brake movements of the valve are obtained, when the cam follower interacts with the auxiliary valve lift sectors. In normal operating conditions of the engine, the valves should not perform these movements and the roller of the rocker is kept slightly remote from the cam so that the cam follower does not interact with the auxiliary valve lift sectors. The distance or clearance between the roller and the cam ensures that only the larger main lift sector on the cam, dedicated to the main exhaust event, causes an opening of the exhaust valve, but not one or several smaller auxiliary lift sectors dedicated to the engine brake function. This clearance is suppressed when engine brake is needed, by moving an activation piston of the rocker to make a close contact between the roller and the cam, so that engine brake dedicated lift sectors on the cam also cause an opening of the valve. An engine brake system having such valve actuation mechanism is described in WO-91/08381

In the case of a system where two valves are to be actuated, the piston can be in contact with the valves through a valve bridge.

When the engine brake valve opening(s) have been performed, a reset function is preferably to be performed. In other words, the activation piston needs to be moved towards its initial position in order to ensure that the valves are closed early enough in order to prevent extended valve lift overlap.

Engine brake systems generally comprise a control valve to direct pressurized control fluid pressure in a chamber adjacent to the piston to move the activation piston from its initial position to its engine brake actuation position. The control valve controls whether or not the engine brake function is activated. This control valve lets pressurized, control fluid flow, at a pressure of for example 2 to 5 bars, towards each rocker as long as the engine brake function is needed, which typically lasts several seconds or tens of seconds during which the engine and the cam shaft may perform several hundreds or thousands of complete revolutions. In some systems, a check valve is provided to prevent any fluid, flow out of the chamber, in some known systems, such as the one described in WO-91/08381, the check valve can nevertheless be forced to an open position, allowing the control fluid to escape the chamber when the engine brake is not needed. This is achieved when no control pressure is sent to the control valve. In known systems, there is only one control valve for several cylinders, so that it is not possible to use the control valve to empty the chamber to allow retraction of the piston, if such retraction is needed for a period of time inferior to one revolution of the camshaft.

It is known, for example from U.S. Pat. No. 6,253,730, to act on the check valve thanks to a stopper which is fixed to a housing, of the engine, so as to open the check valve and release fluid pressure in the chamber so that the piston may move towards its initial position, retracted. This technical solution does not insure a satisfying reliability.

It is desirable to provide a new valve actuation mechanism in which, when a specific operation function of the engine must be activated, the activation piston can be reset to its first position in a more efficient and reliable way than in the prior art.

To this end, an aspect of the invention concerns a valve actuation mechanism for an internal combustion engine on an automotive vehicle, comprising rockers moved by a camshaft, each rocker being adapted to exert a valve opening force on at least a portion of a valve opening actuator of each cylinder, via an activation piston, housed in a bore of the rocker, and movable with respect to the rocker under action of a fluid pressure raise in a chamber fluidly connected to the bore, from a first position to a second position, in which a cam follower of the rocker reads at least one auxiliary valve lift sector of a cam of the camshaft so as to perform an engine operation function, each rocker comprising a check valve adapted to control the fluid pressure raise in said chamber. This valve actuation mechanism is characterized in that it comprises, for each rocker, a stopper fast with a housing of the engine and adapted to exert, on a member of the rocker, a force for opening a valve independent from the check valve, adapted to reduce fluid pressure in the chamber, when the piston has to be moved from its second position to its first position.

Thanks to an aspect of the invention, the actuation piston is allowed to retract back to its first position by releasing the control fluid pressure in the chamber thanks to a valve independent from the check valve, and by a mechanical part acting directly on said valve independently for each rocker. This improves the reliability of the valve actuation mechanism.

According to fluffier aspect for the invention which are advantageous but not compulsory, such a valve actuation mechanism may incorporate one or several, of the following features:

The valve adapted to release fluid pressure from the chamber is a discharge valve adapted to allow fluid flow from the chamber to the outside of the rocker, wherein the piston comprises a first element housed in the bore and movable in translation with respect to the rocker, and a valve member housed in a portion of the first element and movable in translation with respect to the first element along a longitudinal axis of the piston, whereas the discharge valve is formed by a cooperation between the first element and the valve member, and wherein the force of the stopper is exerted on the first element.

The valve member is movable with respect to the first element between a first position, corresponding to a in the closed position of the discharge valve, in which a planar annular surface of the valve member is kept in abutment against a stop of the first element, and a pin of the valve member closes a passageway between the chamber and the hollow portion outside of the rocker.

A traction spring exerts a force between the valve member and the first element, tending to keep the discharge valve in its closed position.

The force exerted by the stopper on the first element is superior to the force exerted by the traction sprung.

In the closed position of a discharge valve, a planar annular surface of the valve member is kept in abutment against a stop of the first element.

In the opened position of the discharge valve, the valve member is offset with respect to the first element so that fluid can circulate between the chamber and the outside of the rocker.

The valve member comprises a contact surface adapted to exert the valve opening force on the valve opening actuator.

The valve member comprises at least one bleed passage adapted to allow passage of fluid from the hollow portion of the first element to the outside of the piston.

The valve member is housed in a hollow portion of the first element.

The valve adapted to reduce fluid pressure in the chamber is a reset valve, adapted to allow fluid flow from the chamber to the outside of the rocker, housed in a portion of the rocker distinct from the actuation piston, and wherein the force of the stopper is exerted on the reset valve The reset valve comprises a ball spring-biased against a seat formed by a surface of the rocker, extending around a bleed passage connecting the chamber to the outside of the rocker, by a compression spring, and wherein the ball cooperates with the pin.

The force exerted by the stopper on the pin is superior to a force exerted by the compression spring on the ball.

The force exerted by the stopper on the member is variable.

The stopper comprises a main spring adapted, when deformed, to exert a compression force on a pushrod which is in contact with the movable member.

It is an exhaust valve actuation mechanism.

The activation piston activates an exhaust gases recirculation function when it is in its second position.

The activation piston activates an engine brake function when it is in its second position.

It is an intake valve actuation mechanism.

The invention also concerns an automotive vehicle, such as a truck, comprising a valve actuation mechanism as mentioned here-above.

BRIEF DESCRIPTION OF THE DRAWINGS

The invention will now be explained in correspondence with the annexed figures, as an illustrative example. In the annexed figures.

DETAILED DESCRIPTION

Figure 1:
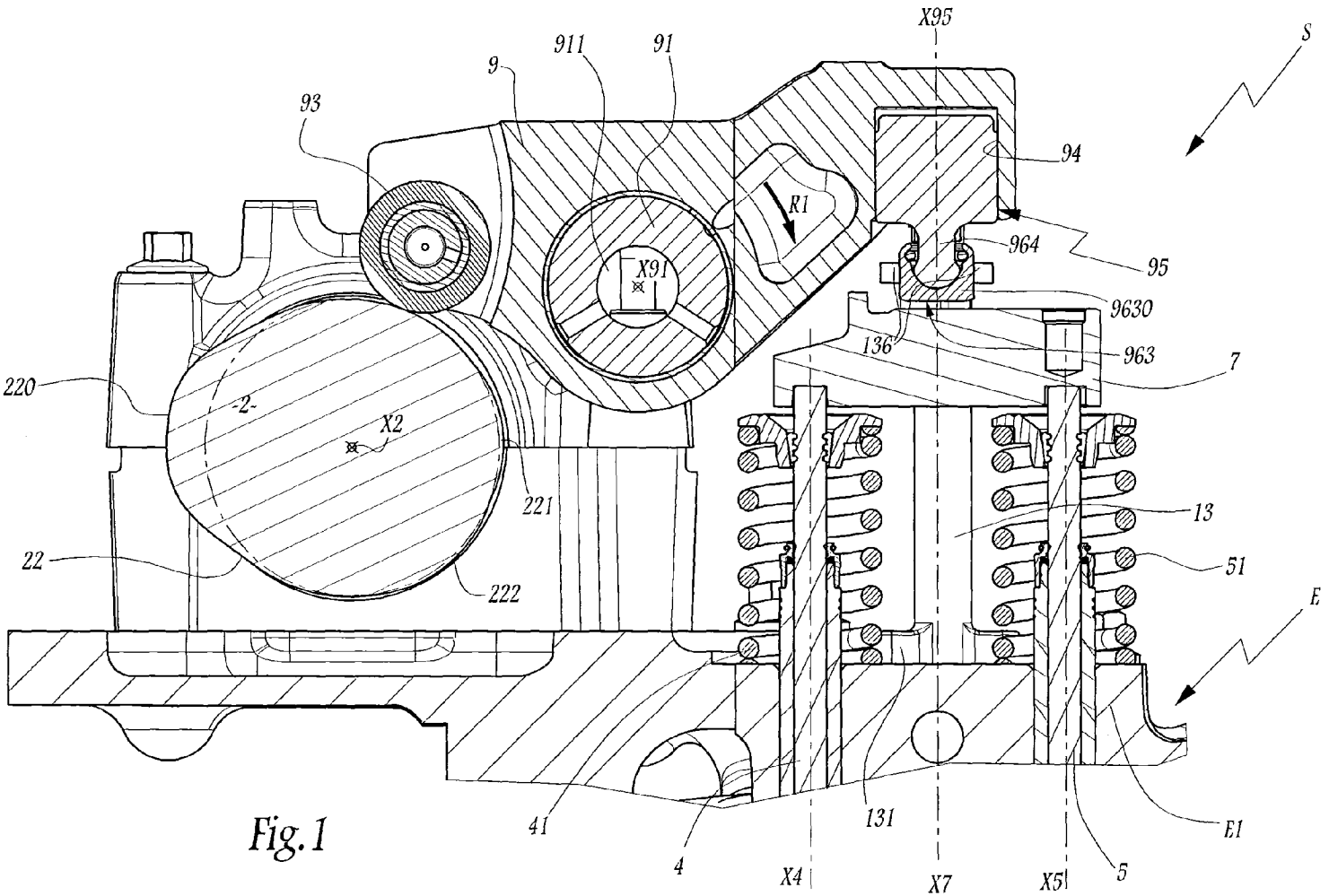
FIG. 1 is a side view partially sectioned of a portion of a valve actuation mechanism according to a first embodiment of the invention.

The valve actuation mechanism S represented on FIG. 1 comprises a camshaft 2 rotatable around a longitudinal axis X2. Camshaft 2 comprises several cams 22, each being dedicated to moving the valves of one cylinder of an internal combustion engine E of a non-represented automotive vehicle on which valve actuation mechanism S is integrated. Each cam has a cam profile which may comprise one or several "bumps", i.e. valve lift sectors where the cam profile exhibits a bigger eccentricity with respect to axis X2 than the base radius of the cam.

In this embodiment, each cylinder of engine E is equipped with two exhaust valves 4 and 5. Valves 4 and 5 are kept in a closed position by respective springs 41 and 51. Each valve 4 and 5 is movable in translation along an opening axis X4 or X5 so as to be opened, or lifted. More precisely, translation of valves 4 and 5 opens a passageway between the combustion chamber of the cylinder and an exhaust manifold. Valves 4 and 5 are connected to a valve bridge 7, which forms a valve opening actuator, and which extends substantially perpendicular to axes X4 and X5. In case only one valve is to be actuated, then the opening actuator can be integral with the valve, for example embodied as a top portion of the valve stem.

Figure 2:
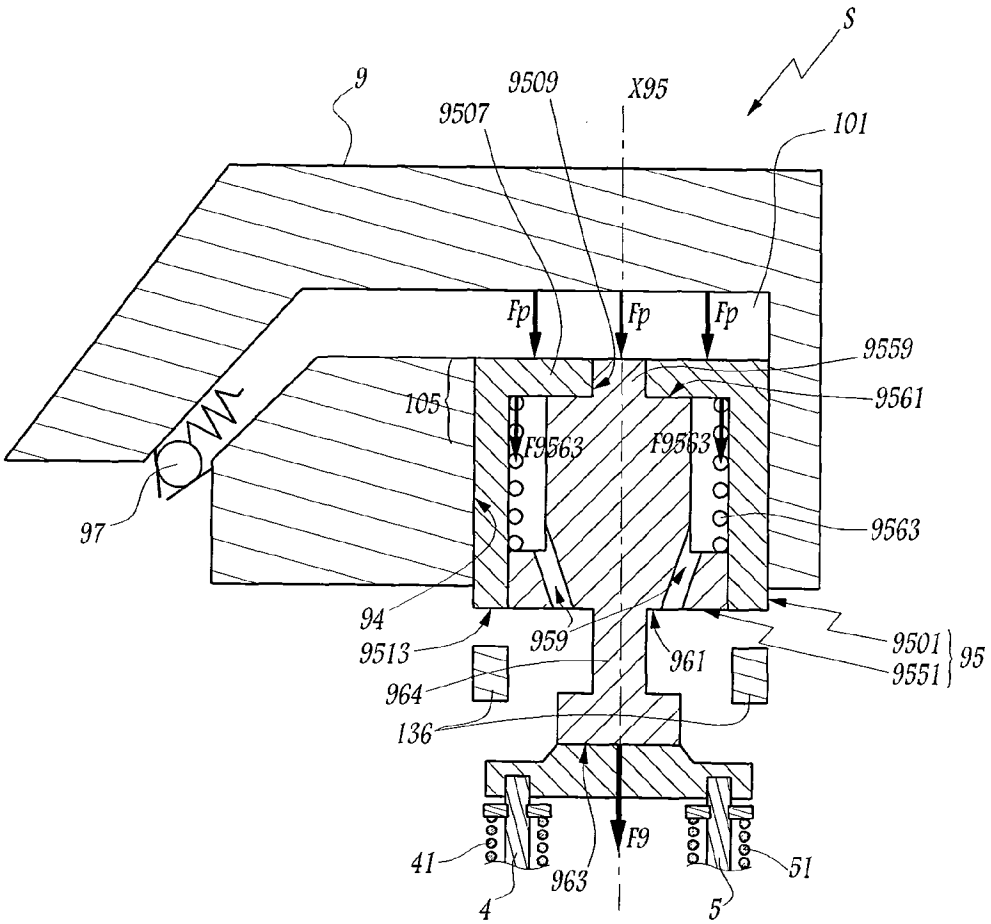
FIG. 2 is a partial sectional schematic view of the valve actuation mechanism of FIG. 1, in a first configuration.
Figure 3:
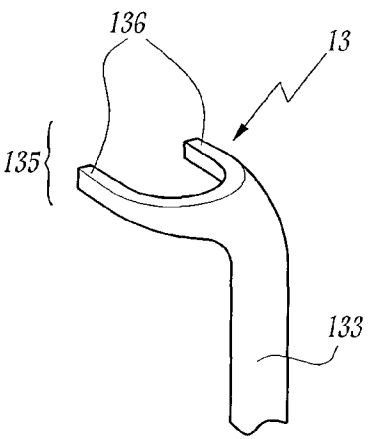
FIG. 3 is a perspective view of a stopper belonging to the valve actuation mechanism of FIGS. 1 and 2.

Valves 4 and 5 are partly represented on FIGS. 1 and 2, only their respective stems are visible.

For each cylinder, the transmission of movement between camshaft 2 and valve bridge 7 is performed by a rocker 9 rotatable with respect to a rocker shaft 91 defining a rocker rotation axis X91. Only one rocker 9 is represented on the figures. Each rocker 9 comprises a roller 93 which acts as a cam follower and cooperates with a cam 22. Roller 93 is located on one side of rocker 9 which respect to shaft 91. Each rocker 9 comprises, opposite to roller 93 with respect to shaft 91 an activation piston 95 adapted to exert a valve opening, force F9 on the whole of valve bridge 7. Particularly, rotation of camshaft 2 transmits, when the roller runs against a valve lift sector of the cam, a rotation movement R1 to rocker 9 via roller 93, this rotation movement inducing a translation movement of valve bridge 7 along an axis X7 which is parallel to axes X4 and X5. The rocker can therefore rotate between a valve closing position and a valve opening position, depending on the cam profile.

Cooperation between a main valve lift sector 220 of cam 22 and roller 93, on the one hand, and between piston 95 and bridge 7, on the other hand, generates exhaust openings of valves 4 and 5 during the corresponding operating phase of internal combustion engine E.

In the shown embodiment, rocker shaft 91 is hollow and defines a duct 91 1 which houses a control fluid circuit connected to a non-shown fluid tank of valve actuation mechanism S. Rocker 9 comprises at non represented internal fluid circuit which fluidly connects duct 911 to a piston chamber 101 of rocker 9, delimited by piston 95, via a check valve 97. Piston 95 is housed in a bore 94 of rocker 9 and adapted to move with respect to chamber 101 along a translation axis X95 corresponding to a longitudinal axis of piston 95.

Cam 22 comprises at least one, here two auxiliary valve lift sectors 221 and 222 which are adapted to cooperate with roller 93. These sectors induce, when read by roller 93 of rocker 9, two additional pivoting movements of rocker 9 on each turn of camshaft 2. The auxiliary lift sectors 221 and 222 are usually designed to cause only a limited lift of the valve, as they are not intended to allow a great flow of gases through the valve. These two pivoting movements are transformed by piston 95 into two opening movements of valves 4 and 5 so as to perform an engine brake function at two precise moments during operation of engine F as described briefly above. The purpose and effects of these valve openings are well-known and will not be further described hereafter. According to an alternate embodiment, cam 22 comprises only one auxiliary valve lift sector for performing only one opening of valves 4 and 5 on each turn of camshaft 2, in addition to the main exhaust valve opening.

When engine E switches to engine brake mode, check valve 97 is opened so that fluid can flow from duct 911 to the inside of rocker 9 and subsequently to piston chamber 101 so as to induce a pressure raise in piston chamber 101. The pressure raise in chamber 101 induces a translation movement of piston 95 outwardly with respect to rocker 9, from a first position, in which piston 95 is entirely or partially pushed back into chamber 101, to a second position, in which piston 95 is partially moved out of piston chamber 101 until it comes in abutment against valve bridge 7. Preferably, the control fluid is a substantially incompressible fluid such as oil.

When piston 95 is in its first position, retracted, as shown on FIG. 2, roller 93 is offset with respect to the auxiliary valve lift sectors 221 and 222 of cam 22 by an engine brake actuation clearance, so that when camshaft 2 rotates around axis X2, cam 22 does not come in contact with roller 93, or piston 95 does not come in contact with valve bridge 7. By moving piston 95 to its second position, extended, as shown on FIG. 4, rocker 9 pivots around the longitudinal axis X91 of shaft 91, in the direction of arrow A1. Thus, the actuation clearance is suppressed and roller 93 comes into contact with the auxiliary valve lift sectors of cam 22, allowing engine brake operations to be implemented.

According, to a variant of the invention, piston 95 may be adapted to activate or deactivate an internal exhaust gases recirculation function. This function allows art exhaust valve opening during the intake stroke. By returning a controlled amount of exhaust gas to the combustion process, peak combustion temperatures are lowered. This will reduce the formation of Nitrogen oxides (NOx).

According to a non-shown embodiment of the invention, valve actuation mechanism S may be an intake valve actuation mechanism for moving two intake valves adapted to open passageway between the combustion chamber of the cylinder and an intake manifold. In this case, the activation piston may be adapted to activate or deactivate an intake function based on late or early Miller cycle (Atkinson).

Valve actuation mechanism S comprises a stopper 3, which has a first end fast to a housing E1 of internal combustion engine E by means of a fastening flange 131. Stopper 13 comprises a rod 133 extending from flange 131, and ending with a fork-shaped pushing zone 135. Pushing zone 135 has a half-circular shape extending between two parallel fingers 136. The part of the engine E housing E1 to which the stopper 13 is attached is preferably the cylinder head, but could be any other part rigidly connected to the cylinder head or to the crankcase.

Piston 95 comprises a first element 9501, which has a hollow portion 9502 and comprises a tubular peripheral wall 9503 parallel to axis X95. A plane circular wall 9507 extends perpendicularly to axis X95 from an end of peripheral wall 9503 on the side of piston chamber 101. Plane wall 9507 comprises a central hole 9509 aligned with axis X95. Central hole 9509 forms a fluid passageway between chamber 101 and hollow portion 9502 of first element 9501.

First element 9501 is mounted within a corresponding cylinder bore 94 created in the rocker 9 in the continuation of the chamber 101 and having the same axis X95 and first element is adapted to move in translation with respect to rocker 9 along axis X95.

Piston 95 further comprises a valve member 9551 housed in hollow portion 9502 of first element 9501 and movable in translation with respect to first element 9501, and subsequently with respect to rocker 9, along axis X95. Hollow portion 9502 is defined as the inside of the tubular peripheral wall 9503. Valve member 9551 comprises two bleed passages 959 adapted to let fluid flow from hollow portion 9502 of first element 9501 to the outside of rocker 9. Valve member 9551 may comprise only one bleed passage 959.

Valve member 9551 comprises a pin 9559 having a form corresponding to the form of central hole 9509. Pin 9559 extends from a planar annular surface 9561 adapted to come in abutment against a portion of plane wall 9507, which acts as a stop, under action of a traction force F9563 exerted by a spring 9563 arranged between first element 9501 and valve member 9551. The cooperation between pin 9559 and surface 9911 forms a discharge valve 105.

Piston 95 has a pushing surface 963 realized on a mobile element 9630 mounted in spherical joint on a pin 964 which extends from a surface 961 of valve member 9551. The mobility of element 9630 permits to make a plane contact between valve bridge 7 and surface 963.

Fingers 136 of stopper 3 are adapted to cooperate with an annular outer edge 9513 of first element 9501, located on the outside of rocker 9.

Valve actuation mechanism S works in the following way: when rocker 9 is in a position corresponding to the closed state of valves 4 and 5, a clearance C1 separates edge 9513 from pushing zone 135 of fork stopper 13. Prior to the engine brake valve openings, piston 95 is moved to its second position thanks to a fluid pressure raise in chamber 101.

Once the two engine brake valve openings have been realized, thanks to a rotation R1 of rocker 9, a main exhaust opening of valves 4 and 5 is to be realized. Therefore, during the opening of valves 4 and 5, piston 95 must be progressively pushed back to its first position. When rotation R1 of rocker 9 approaches its maximal angular value, contact is made between edge 9513 and fingers 136 of fork stopper 13. At this moment, the exertion of a force F13 by stopper 13 on first element 9501 begins.

The exertion of force F13 on edge 9513 induces a movement of first element 9501 along axis X95 towards chamber 101 while valve member 9551 remains in the same position with respect to rocker 9, under action of fluid pressure force Fp exerted on pin 9559.

Figure 4:
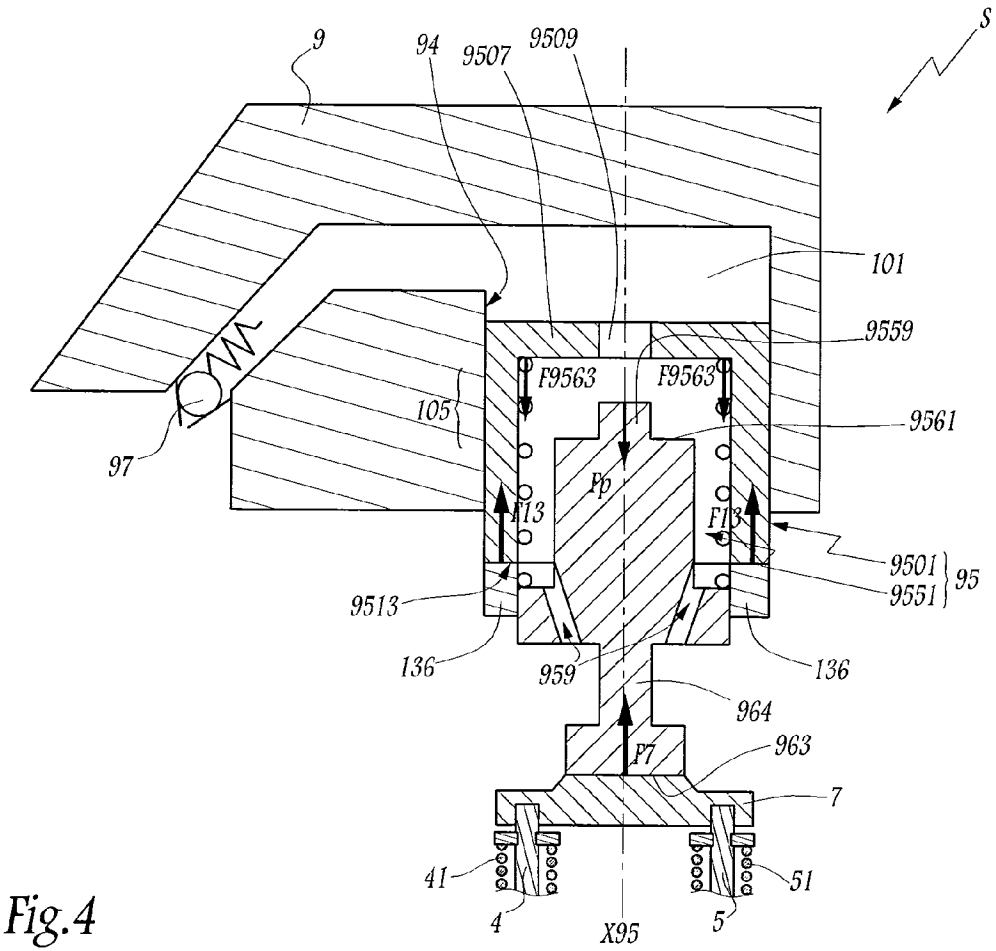
FIG. 4 is a view similar to FIG. 2, for a second configuration of the valve actuation mechanism of FIGS. 1 to 3.

Planar annular surface 9561 therefore becomes remote from plane wall 9507, as shown on FIG. 4, causing discharge valve 105 to open and provoking fluid flow inside hollow portion 9502 of first element 9501. Fluid is purged outside rocker 9 via bleed passages 959 which are realized in base portion 9557 of valve member 9551. Valve member 9551 is moved towards chamber 101 under action of spring 9563, until a contact is made again between surface 9564 and wall 9507. Piston 95 is then pushed in its first position under action of bridge 7, which exerts a force F7 on valve member 9551 induced by springs 41 and 51 which return valves 4 and 5 to their closed positions.

In other words, during a movement of the rocker 9 towards the opening of the valves 4 and 5 corresponding to a main exhaust event, the stopper will block the movement of first element 9501 with respect to the engine casing. Due to the fact that the rocker continues its movement towards the valve bridge 7, the pressure in the main chamber, acting on the pin 9559 causes the valve member 9551 to continue the movement in the direction of the valve bridge. Therefore, there is a tendency for the valve member 9551 and the first element 9501 to separate, and when the pin 9559 escapes of hole 9509, the control fluid contained in chamber 101 can be discharged though the central hole 9509 and then through bleed passages 959.

Preferably, the system is calibrated so that the discharge valve 99 opens when pressure in chamber 101 reaches a value approximately equal to 30 bars.

Figure 5:
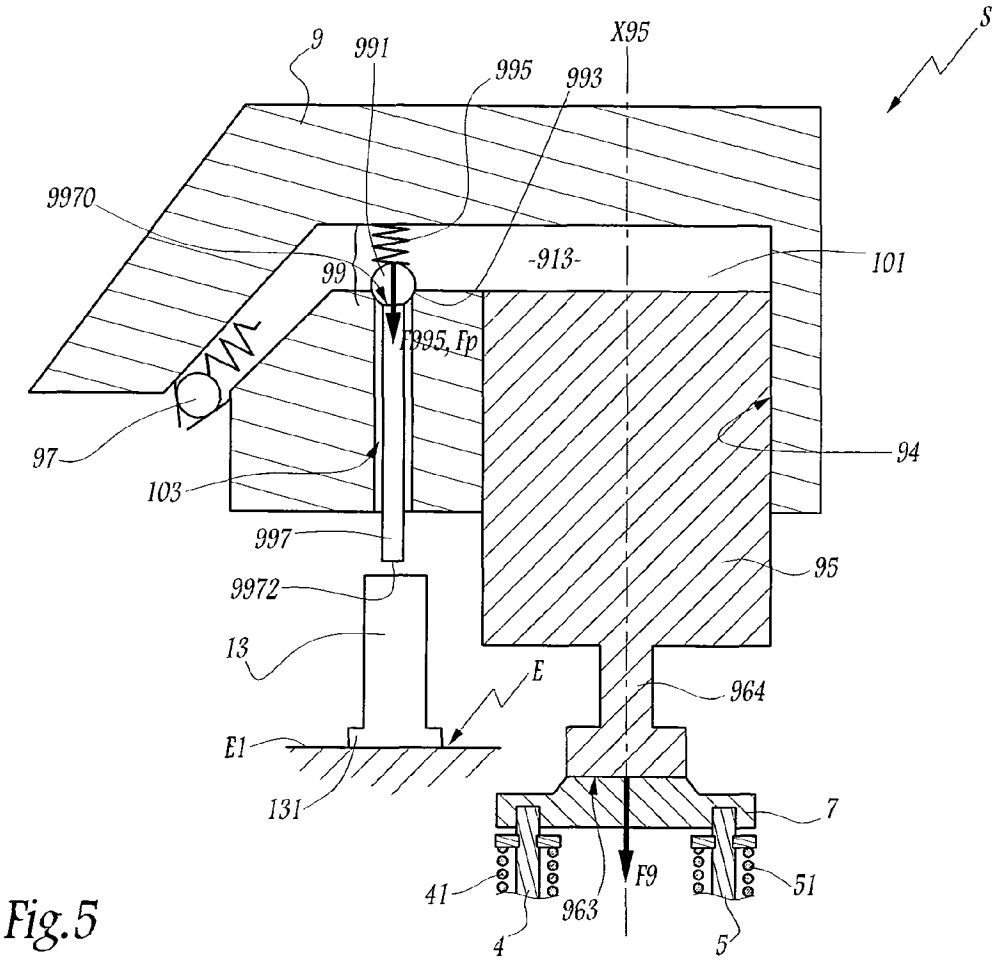
FIG. 5 is a view similar to FIGS. 2 and 4, of a valve actuation mechanism according to a second embodiment of the invention, in a first configuration.
Figure 6:
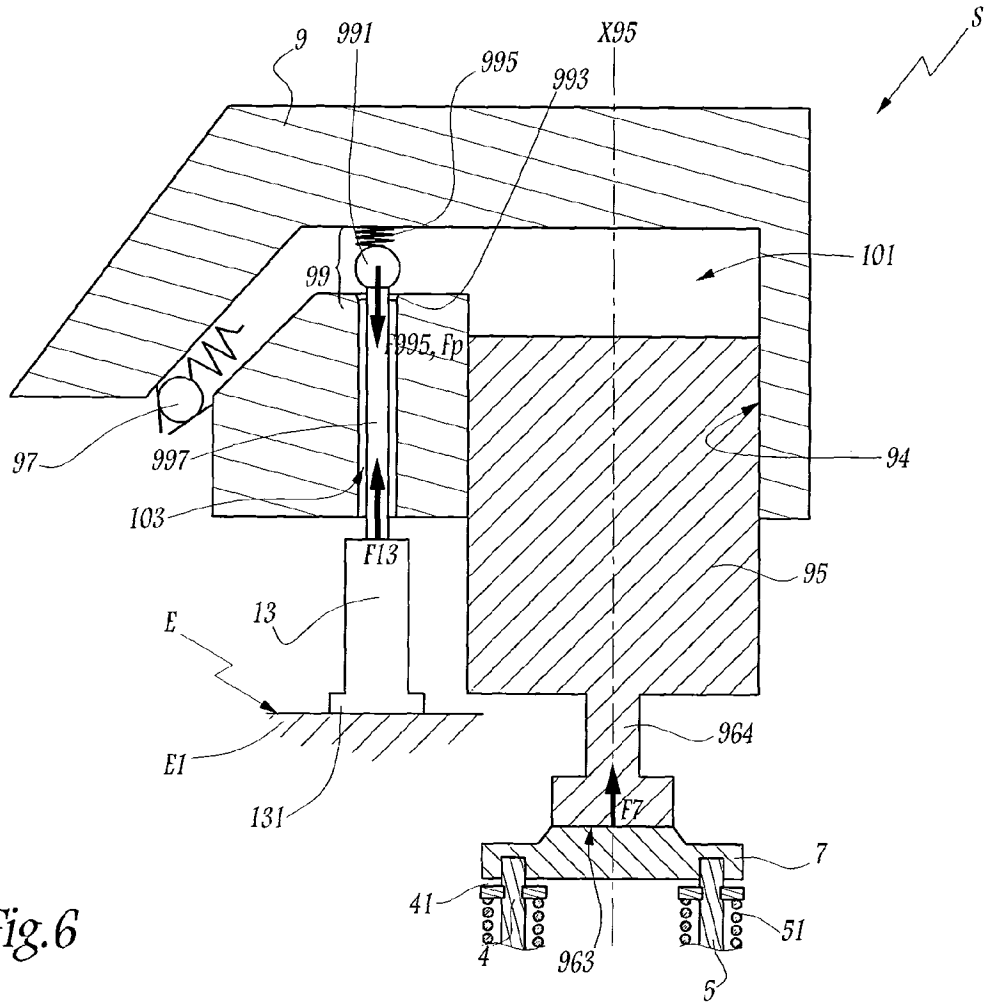
FIG. 6 is a view similar to FIG. 5, for a second configuration of the valve actuation mechanism of FIG. 5.

A second embodiment of the invention is represented on FIGS. 5 and 6. Elements similar to the first embodiment have the same references and work in the same way. In this embodiment, piston 95 housed in bore 94 is made of a single part and does not necessarily comprise any hollow portion. Rocker 9 comprises a bleed passage 103, located apart from piston 95 and apart from check valve 97, and fluidly connecting piston chamber 101 to the outside of rocker 9. At the connection between bleed passage 103, and a duct 913 fluidly connecting check valve 97 to piston chamber 101, rocker 9 comprises a reset valve 99 adapted to release fluid pressure in piston chamber 101 by opening bleed passage 103 for letting fluid flow outside chamber 01.

Reset valve 99 is a normally closed valve which can be forced to open by the stopper 13. For example the reset valve comprises a closure member, here in the form of a ball 991 which is spring-biased against a seat 993 realized on a surface of rocker 9. A compression spring 995, exerting a compression force F995 on ball 991, keeps ball 991 in sealing contact against seat 993 and keeps therefore reset valve 99 in its closed position. Ball 991 is also urged against seat 993 by a fluid pressure force Fp exerted by fluid in duct 913.

A pin 997 is slidably mounted in bleed passage 103 in a substantially parallel direction to axis X95. Pin 997 comprises a first valve actuation end 9970 adapted to cooperate, by making a contact, with ball 991. On its other end, pin 997 comprises a pushing surface 9972 adapted to cooperate with stopper 13 in the vicinity of the outside of rocker 9.

In this embodiment, stopper 13 is a cylindrical part ending with a planar actuation zone adapted to cooperate with pin 997 to exert a force F13 on ball 991.

This embodiment works in the following way: at the time a pre-determined rotation angle of rocker 9, corresponding to the time when piston 95 has to be moved, from its second position to its first position, has been reached, a contact is made between a stopper 13, fast with a housing E1 of engine F, and pushing surface 9972. Force F13 is exerted on pin 997 and subsequently transmitted to ball 991. Force F13 overcomes forces F995 and Fp, resulting in moving ball 991 away from seat 993. Thus, reset valve 99 is opened and fluid is purged outside chamber 101 and outside rocker 9. As in the first embodiment, fluid pressure in chamber 101 drops, allowing piston 95 to be pushed back in its first position under action of force F7 exerted by springs 41 and 51 on bridge 7 and transmitted to piston 95.

It can be noted that, in an alternate embodiment, the stopper 13 could act directly on the closure member of the reset valve 99 to cause the opening of the valve.

According to a non-shown embodiment of the invention, valve actuation mechanism S can be implemented with single valve brake technology, in which the engine brake function is performed by opening only one of exhaust valves 4 and 5.

According to a non-shown embodiment of the invention, valve actuation mechanism S may apply to an engine having cylinders equipped with a single exhaust valve and a single intake valve. In this case, each rocker 9 is adapted to move only one valve, and the valve opening actuator does not comprise any bridge, the single exhaust or intake valve being moved via an intermediate part adapted to cooperate with piston 95.

Figure 7:
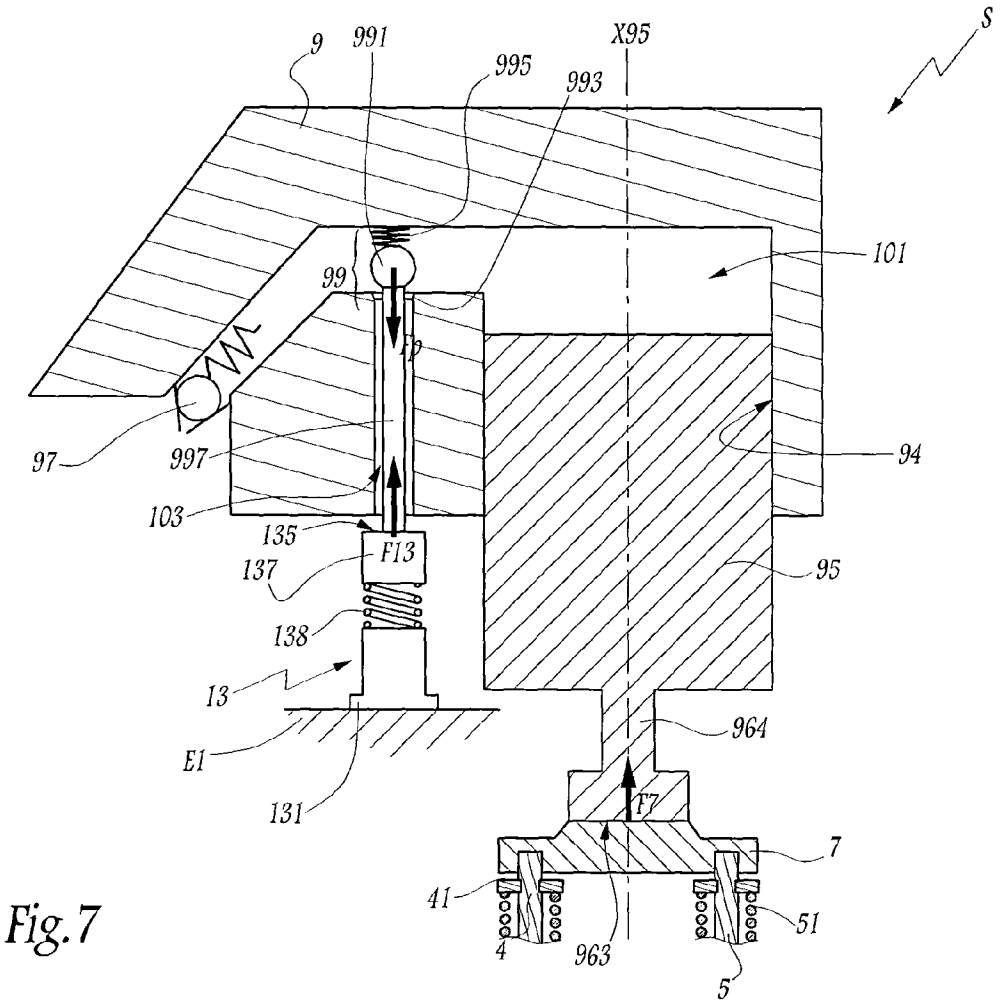
FIG. 7 in a view similar to FIG. 6, for a valve actuation mechanism according to a third embodiment of the invention.

A third embodiment of the invention is represented on FIG. 7. Hereafter, only the differences with the embodiment of FIG. 6 are discussed. In this embodiment, stopper 13 exerts a variable force F13 which becomes superior to the force Fp which keeps reset valve 99 in its closed position only when piston 95 has to be moved from its second position to its first position. Stopper 13 comprises a pushrod 137 carrying pushing zone 135, and a spring 138 exerting a force on pushrod 137. This arrangement permits to operate the reset function at the right speed and with relatively low forces involved. The hysteresis effect of spring 138 implies that force F 3 remains superior force Fp until piston 95 is back in its first position.

This embodiment is described as implemented with the design of the embodiment of FIGS. 5 and 6. The embodiment of FIG. 7 can be combined with the designs of embodiments of FIGS. 1 to 4. Particularly, stoppers 13 described in the embodiments of FIGS. 1 to 4 can be equipped with a spring 138 to exert a variable force F13.

In all the above embodiments, the position of the stopper, which is fixed with respect to the engine housing, can be set so that it interferes with the piston during the travel of the rocker at a given position of the rocker between its valve closing, and valve opening positions. Therefore, the position of the stopper with respect to the housing and with respect to the rocker defines the timing at which the activation piston has to be moved from its second position to its first position in the valve opening and closing cycle. The position of the stopper can be made adjustable for a fine-tuning of the timing at which the activation piston is effectively moved from its second position to its first position.

The invention claimed is:

1. A valve actuation mechanism for an internal combustion engine on an automotive vehicle, comprising rockers moved by a camshaft, each rocker being adapted to exert a valve opening force on at least a portion of a valve opening actuator of each cylinder, via an activation piston, housed in a bore of the rocker and movable with respect to the rocker under action of a fluid pressure raise in a chamber fluidly connected to the bore, from a first position to a second position with respect to the rocker, in which a cam follower of the rocker is adapted to read at least one auxiliary valve lift sector of a cam of the camshaft so as to perform an engine operating function, each rocker comprising a check valve adapted to control the fluid pressure raise in said chamber, wherein the valve actuation mechanism comprises, for each rocker, a stopper fast with a housing of the engine and adapted to exert, on a member of the rocker, a force for opening a valve independent from the check valve, adapted to release fluid from the chamber when the piston has to be moved from its second position to its first position.

2. The valve actuation mechanism according to claim 1, wherein the valve adapted to release fluid from the chamber is a discharge valve adapted to allow fluid flow from the chamber to the outside of the rocker, wherein the piston comprises a first element housed in the bore and movable in translation with respect to the rocker, and a valve member housed in a portion of the first element and movable in translation with respect to the first element along a longitudinal axis (X95) of the pistol, wherein the discharge valve is formed by a cooperation between the first element and the valve member, and wherein the force of the stopper is exerted on the first element.

3. The valve actuation mechanism according to claim 2, wherein in the closed position of the discharge valve, a pin of the valve member closes a passageway between the chamber and the outside of the rocker.

4. The valve actuation mechanism according to claim 2, wherein a traction spring exerts a force between the valve member and the first element, tending to keep the discharge valve in its closed position.

5. The valve actuation mechanism according to claim 2, wherein in the closed position of the discharge valve, a planar annular surface of the valve member is kept in abutment against a stop of the first element.

6. The valve actuation mechanism according to claim 2, wherein in the opened position of the discharge valve, the valve member is offset with respect to the first element so that fluid can circulate between the chamber and the outside of the rocker.

7. The valve actuation mechanism according to claim 2, wherein the valve member comprises a contact surface (963) adapted to exert the valve opening force on the valve opening actuator.

8. The valve actuation mechanism according to claim 2, wherein the valve member comprises at least one bleed passage adapted to allow passage of fluid from the hollow portion of the first element to the outside of the piston.

9. The valve actuation mechanism according to claim 2, wherein the valve member is housed in a hollow portion of the first element.

10. The valve actuation mechanism according to claim 1, wherein the valve adapted to reduce fluid pressure in the chamber is a reset valve, adapted to allow fluid flow from the chamber to the outside of the rocker, housed in a portion of the rocker distinct from the actuation piston, and wherein the force of the stopper is exerted on the reset valve.

11. The valve actuation mechanism according to claim 10, wherein the reset valve comprises a ball spring-biased against a seat formed by a surface of the rocker, extending around a bleed passage (103) connecting the chamber to the outside of the rocker, by a compression spring.

12. The valve actuation mechanism according to claim 1, wherein the force exerted by the stopper on the member is variable.

13. The valve actuation mechanism according to claim 12, wherein the stopper comprises a main spring adapted, when deformed, to exert a compression force on a pushrod which is in contact with the movable member.

14. The valve actuation mechanism according to claim 1, wherein it is an exhaust valve actuation mechanism.

15. The valve actuation mechanism according to claim 14, wherein the activation piston activates an exhaust gases recirculation function when it is in its second position.

16. The valve actuation mechanism according to claim 14, wherein the activation piston activates an engine brake function when it is in its second position.

17. The valve actuation mechanism according to claim 1, wherein it is an intake valve actuation mechanism.

18. Automotive vehicle comprising a valve actuation mechanism according to claim 1.

* * * * *